US008159408B2

(12) United States Patent
Rofougaran

(10) Patent No.: US 8,159,408 B2
(45) **Date of Patent: *Apr. 17, 2012**

(54) METHOD AND SYSTEM FOR SOFTWARE DEFINED ANTENNA CONTROL

(75) Inventor: Ahmadreza Rofougaran, Newport Coast, CA (US)

(73) Assignee: Broadcom Corporation, Irvine, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/983,978

(22) Filed: Jan. 4, 2011

(65) Prior Publication Data

US 2011/0102291 A1 May 5, 2011

Related U.S. Application Data

(63) Continuation of application No. 11/679,003, filed on Feb. 26, 2007, now Pat. No. 7,864,133.

(51) Int. Cl.
*H01Q 1/50* (2006.01)
*H01Q 9/00* (2006.01)
*H01Q 3/24* (2006.01)

(52) U.S. Cl. ..... 343/861; 343/850; 343/745; 343/876

(58) Field of Classification Search ..... 343/745, 343/850, 861, 876

See application file for complete search history.

(56) References Cited

U.S. PATENT DOCUMENTS 4,965,607 A * 10/1990 Wilkins et al. ..... 343/861
5,991,643 A * 11/1999 Chao-Cheng ..... 455/575.7
6,965,837 B2 * 11/2005 Vintola ..... 702/65
7,663,555 B2 * 2/2010 Caimi et al. ..... 343/702
7,821,466 B2 * 10/2010 Lempkowski ..... 343/745

* cited by examiner

*Primary Examiner* — Jacob Y Choi
*Assistant Examiner* — Hasan Islam
(74) *Attorney, Agent, or Firm* — Farjami & Farjami LLP

(57) ABSTRACT

Methods and systems for reducing AM/PM and AM/AM distortion are disclosed and may comprise selectively coupling and impedance matching one of a plurality of tunable antennas to a single programmable output stage comprising a single power amplifier in a transmitter. A programmable matching circuit comprising adjustable inductance and capacitance may be used to impedance match the antenna to the output stage. The selected tunable antenna may be coupled to the output stage utilizing a programmable switch array, which may comprise at least one transistor integrated on an integrated circuit including the output stage, for example. The tunable antennas may be designed to operate in different frequency bands and to be tuned within one or more frequency bands. The programmable matching circuit may be integrated on the chip or external to the chip. The matching circuit capacitance may be integrated on-chip, and the inductance may be located off-chip.

20 Claims, 5 Drawing Sheets

METHOD AND SYSTEM FOR SOFTWARE DEFINED ANTENNA CONTROL

CROSS-REFERENCE TO RELATED APPLICATIONS/INCORPORATION BY REFERENCE

This application is a continuation of U.S. application Ser. No. 11/679,003 filed Feb. 26, 2007. This application also makes reference to:

U.S. patent application Ser. No. 11/536,678 filed on Sep. 29, 2006;

U.S. patent application Ser. No. 11/678,790, now U.S. Pat. No. 7,729,683, filed on Feb. 26, 2007;

U.S. patent application Ser. No. 11/678,797, now U.S. Pat. No. 7,616,941, filed on Feb. 26, 2007;

U.S. patent application Ser. No. 11/678,984 filed on Feb. 26, 2007; and

U.S. patent application Ser. No. 11/678,990 filed on Feb. 26, 2007.

Each of the above stated applications is hereby incorporated herein by reference in its entirety.

FEDERALLY SPONSORED RESEARCH OR DEVELOPMENT

[Not Applicable]

MICROFICHE/COPYRIGHT REFERENCE

[Not Applicable]

FIELD OF THE INVENTION

Certain embodiments of the invention relate to RF transmitters. More specifically, certain embodiments of the invention relate to a method and system for software defined antenna control.

BACKGROUND OF THE INVENTION

Wireless devices use antennas to receive RF signals. The size of an antenna may depend on the wavelength of the RF signals that the wireless device is designed to receive. Typically, larger antennas are needed for signals with larger wavelengths. Accordingly, a mobile terminal may use antennas of a few inches for signals in the GHz range. However, for FM radio signals in the 100 MHz range, the antennas may need to be longer. As corded headsets gained popularity with mobile terminal users, many mobile terminal manufacturers used the headphone cord as an antenna, for example, for an FM receiver.

However, with the advent of Bluetooth headsets, the need for corded headsets has declined. The mobile terminal manufacturers have devised alternate means for implementing an FM antenna. One such antenna comprises a conductive coil or loop on a small circuit board that is typically placed at the back of the mobile terminal. Since this small FM antenna is limited in size, the antenna may be tuned to support the FM radio bandwidth. Additionally, because of the circuit board antenna's limited ability to receive FM signals, external factors may be a big factor to reception sensitivity. For example, a mobile terminal user holding the mobile terminal may cause the designed center frequency of the FM antenna to shift due to capacitive and/or inductive changes. Additionally, the mobile terminal's components, such as, the battery, may interfere with reception and/or change the antenna characteristics of the circuit board antenna by distorting and/or shorting the circuit board antenna.

Wireless systems are typically designed to function at a specific frequency, 900 MHz or 1.8 GHz, for example, and utilizing a defined standard such as GSM, WCDMA, EDGE, for example. Thus, wireless systems including antennas may have to be designed for a specific application with device performance optimized for that application.

Further limitations and disadvantages of conventional and traditional approaches will become apparent to one of skill in the art, through comparison of such systems with the present invention as set forth in the remainder of the present application with reference to the drawings.

BRIEF SUMMARY OF THE INVENTION

A system and/or method for software defined antenna control, substantially as shown in and/or described in connection with at least one of the figures, as set forth more completely in the claims.

Various advantages, aspects and novel features of the present invention, as well as details of an illustrated embodiment thereof, will be more fully understood from the following description and drawings.

DETAILED DESCRIPTION OF THE INVENTION

Certain aspects of the invention may be found in a method and system for software defined antenna control. Exemplary aspects of the invention include selectively coupling and impedance matching one of a plurality of tunable antennas to a single programmable output stage comprising a single power amplifier on a chip in a transmitter. A programmable matching circuit comprising adjustable inductance and capacitance may be used to impedance match the antenna to the output stage. The selected tunable antenna may be coupled to the output stage utilizing a programmable switch array, the latter of which may comprise at least one integrated transistor, for example. The tunable antennas may be designed to operate in different frequency bands and to be tuned within one or more frequency bands. The programmable matching circuit may be integrated within the chip or located externally to the chip. The matching circuit capacitance may be integrated on-chip, and the inductance may be located off-chip.

Figure 1A:
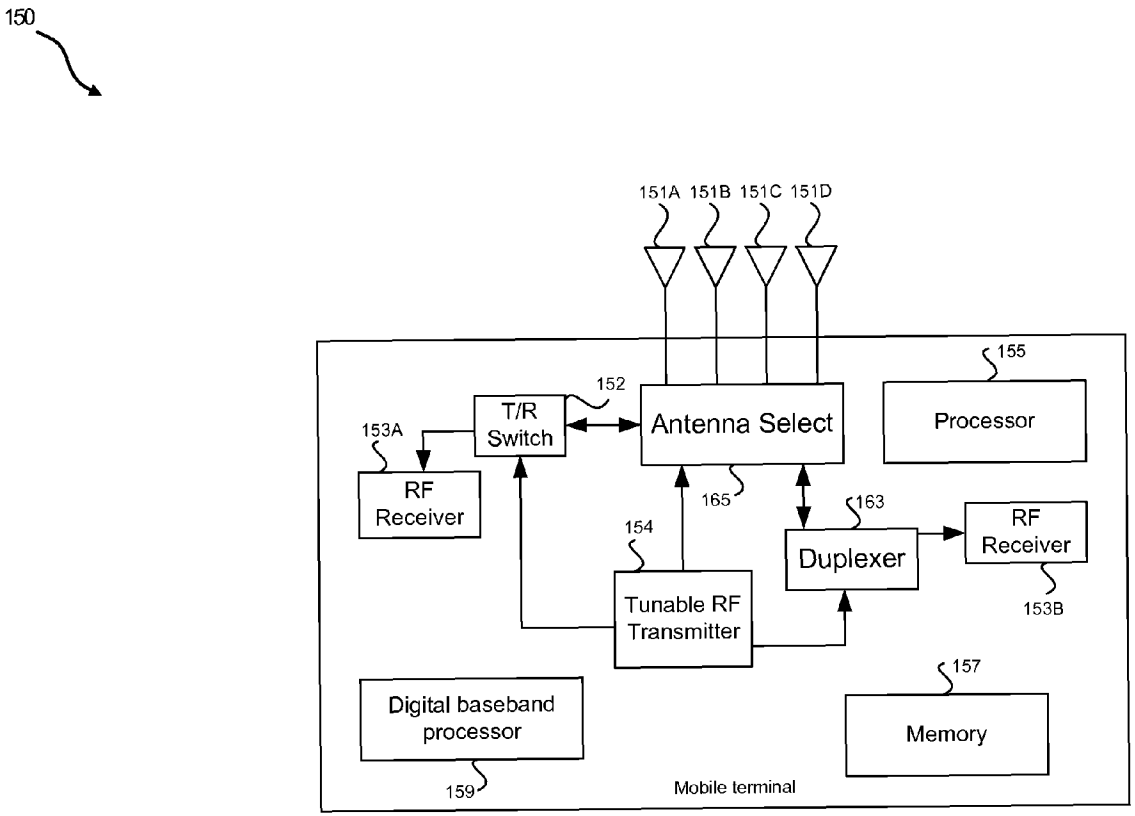
FIG. 1A is a block diagram of an exemplary multi-band mobile terminal which may utilize a single tunable output stage with selectable antennas, in accordance with an embodiment of the invention.

FIG. 1A is a block diagram of an exemplary multi-band mobile terminal which may utilize a single tunable output stage with selectable antennas, in accordance with an embodiment of the invention. Referring to FIG. 1A, there is shown mobile terminal 150 that may comprise RF receivers 153A and 153B, a tunable RF transmitter 154, a T/R switch 152, a digital baseband processor 159, a processor 155, a memory 157, a duplexer 163, and an antenna select block 165. An array of antennas 151A, 151B, 151C and 151D may be communicatively coupled to the antenna select block 165, with each antenna designed for a specific frequency range. The antenna select block 165 may couple an appropriate antenna to the mobile terminal 150, depending on the frequency requirements of the system. The T/R switch 152 may be utilized in applications where full duplex operation is not required, and when the T/R switch 152 may be set to "R", or receive, the antenna 151A, 151B, 151C, or 151D may be communicatively coupled to the RF receiver 153A, and in instances when the T/R switch 152 may be set to "T", or transmit, the antenna 151A, 151B, 151C, or 151D may be communicatively coupled to the tunable RF transmitter 154.

The RF receivers 153A and 153B may comprise suitable logic, circuitry, and/or code that may enable processing of received RF signals. The RF receivers 153A and 153B may enable receiving of RF signals in frequency bands utilized by various wireless communication systems, such as Bluetooth, WLAN, GSM, and/or WCDMA, for example. Systems requiring full duplex mode may utilize the RF receiver 153B, and systems not requiring full duplex may utilize the RF receiver 153A.

The digital baseband processor 159 may comprise suitable logic, circuitry, and/or code that may enable processing and/or handling of baseband signals. In this regard, the digital baseband processor 159 may process or handle signals received from the RF receiver 153A and/or signals to be transferred to the tunable RF transmitter 154 for transmission via a wireless communication medium. The digital baseband processor 159 may also provide control and/or feedback information to the RF receivers 153A and 153B and to the tunable RF transmitter 154, based on information from the processed signals. The digital baseband processor 159 may communicate information and/or data from the processed signals to the processor 155 and/or to the memory 157. Moreover, the digital baseband processor 159 may receive information from the processor 155 and/or the memory 157, which may be processed and transferred to the RF transmitter 154 for transmission to the wireless communication medium.

The tunable RF transmitter 154 may comprise suitable logic, circuitry, and/or code that may enable processing of RF signals for transmission. The tunable RF transmitter 154 may enable transmission of RF signals in frequency bands utilized by various wireless communications systems, such as Bluetooth, WLAN, GSM and/or WCDMA, for example, and as such may be frequency tunable and standard selectable.

The processor 155 may comprise suitable logic, circuitry, and/or code that may enable control and/or data processing operations for the mobile terminal 150. The processor 155 may be utilized to control at least a portion of the RF receivers 153A and 153B, the tunable RF transmitter 154, the digital baseband processor 159, and/or the memory 157. In this regard, the processor 155 may generate at least one signal for controlling operations within the mobile terminal 150.

The memory 157 may comprise suitable logic, circuitry, and/or code that may enable storage of data and/or other information utilized by the mobile terminal 150. For example, the memory 157 may be utilized for storing processed data generated by the digital baseband processor 159 and/or the processor 155. The memory 157 may also be utilized to store information, such as configuration information, that may be utilized to control the operation of at least one block in the mobile terminal 150. For example, the memory 157 may comprise information necessary to configure the RF receivers 153A and/or 153B to enable receiving RF signals in the appropriate frequency band.

The antenna select block 165 may comprise suitable circuitry, logic and/or code for selectively coupling on of the antennas 151A, 151B, 151C, or 151D to the T/R switch 152, the duplexer 163 and/or the tunable RF transmitter 154. The antenna select block 165 may comprise an addressable array of transistors, for example, which may enable switching between the antennas 151A, 151B, 151C, and/or 151D.

The duplexer 163 may comprise suitable circuitry, logic and/or code for combining two signals, the output generated by the tunable RF transmitter 154 and the signal received by the antenna 151A, 151B, 151C, or 151D via the antenna select block 165, into one such that communication may be transmitted and received on the same antenna concurrently. The duplexer 163 may be utilized in applications, such as WCDMA, for example, where full duplex communication may be required.

In operation, the tunable RF transmitter 154 may be enabled to generate an amplified RF signal. Depending on the wireless communication standard being utilized, the signal may be communicated to the duplexer 163, the antenna select block 165 or the T/R switch 152. The duplexer 163 may enable two-way communication of signals, for example the signal generated by the tunable RF transmitter 154 to the antenna 151A, 151B, 151C and/or 151D via the antenna select block 165 and the signal received by the selected antenna or antennas 151A, 151B, 151C and/or 151D to the RF receiver 153B. In another embodiment of the invention, the signal generated by the tunable RF transmitter 154 may be communicated directly to the antenna select block without requiring the T/R switch 152.

In another embodiment of the invention, in instances where duplex communication may not be required, the signal generated by the tunable RF transmitter 154 may be communicated to the selected antenna or antennas 151A, 151B, 151C and/or 151D via the T/R switch 152 and the antenna select block 165.

Figure 1B:
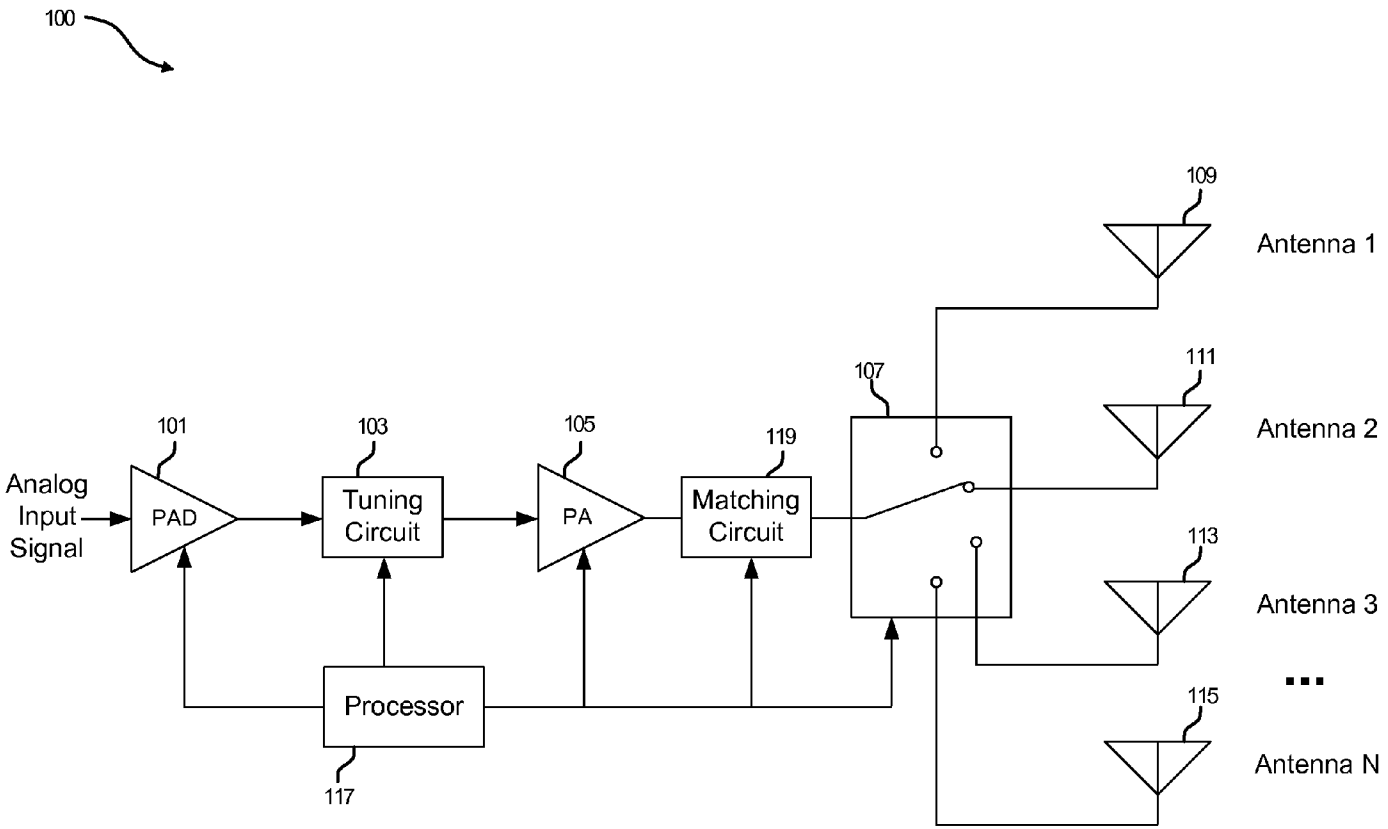
FIG. 1B is a block diagram illustrating an exemplary tunable output stage with an antenna array, in accordance with an embodiment of the invention.

FIG. 1B is a block diagram illustrating an exemplary tunable output stage with an antenna array, in accordance with an embodiment of the invention. Referring to FIG. 1, there is shown a tunable output stage 100 comprising a PAD 101, a tuning circuit 103, a PA 105, a switch 107, antennas 109, 111, 113 and 115, a processor 117, and a matching circuit 119.

The PAD 101 may comprise suitable circuitry, logic and/or code for receiving analog input signals and generating an output signal for driving a power amplifier. The PAD 101 may receive as inputs, control signals, which may be generated by the processor 117. The received control signal may be utilized to set a gain or attenuation level of the PAD 101. The PAD 101 may be enabled to receive the output signal generated by the baseband stages of the transmitter. The PAD 101 may be enabled to generate an output signal that may be communicated to the tuning circuit 103.

The tuning circuit 103 may comprise suitable circuitry, logic and/or code for determining the frequency band that may be communicated to the PA 105. The tuning circuit 103 may comprise selectable capacitors and inductors that may determine the center frequency and bandwidth of the tuning circuit 103. The frequency and bandwidth of the tuning circuit 103 may be controlled by the processor 117.

The PA 105 may comprise suitable circuitry, logic and/or code that may enable amplification of input signals to generate a transmitted signal of sufficient signal power (as measured by dBm, for example) for transmission via a wireless communication medium. The PA 105 may receive as inputs, control signals, which may be generated by the processor 117. The received control signal may be utilized to set a gain or attenuation level of the PA 105. The PA 105 may receive the output signal generated by the tuning circuit 103 and provide a gain level as determined by the output signal desired at the antenna 109, 111, 113 and/or 115. The gain level may be determined depending on the desired application standard, such as GSM, EDGE, or WCDMA, for example.

The switch 107 may comprise suitable circuitry, logic and/or code that may enable the selection of the antenna, 109, 111, 113 or 115 that may be coupled to the output of the matching circuit 119. The switch 107 may be controlled by the processor 117. The switch 107, described further with respect to FIG. 3 may comprise an array of CMOS transistors, for example, that may be switched to select an antenna to receive output signals from the PA 105 via the matching circuit 119. In this manner, the switch 107 may be integrated with the tunable output stage 100, thus eliminating the need for an external T/R switch.

The antennas 107, 109, 111 and 113 may comprise suitable circuitry for transmitting an RF signal. Each antenna may be designed to transmit in a particular frequency range and the impedance of each antenna may match the output impedance of the PA 105 utilizing the matching circuit 119. The total number of antennas may be determined by the frequency requirements of the system.

The processor 117 may comprise suitable logic, circuitry, and/or code that may enable processing of binary data contained within an input baseband signal. The processor 117 may perform processing tasks, which correspond to one or more layers in an applicable protocol reference model (PRM). For example, the processor 117 may perform physical (PHY) layer processing, layer 1 (L1) processing, medium access control (MAC) layer processing, logical link control (LLC) layer processing, layer 2 (L2) processing, and/or higher layer protocol processing based on input binary data. The processing tasks performed by the processor 117 may be referred to as being within the digital domain. The processor 117 may also generate control signals to control the PAD 101, the tuning circuit 103, the PA 105, the matching circuit 119 and/or the switch 107 based on the processing of the input binary data.

In operation, the tunable output stage 100 may be intended for receiving an analog input signal and applying an appropriate gain to the signal such that the power transmitted by the antenna, 109, 111, 113 or 115 may be at a desired level. The input signal may be communicated to the PAD 101, which may provide gain or attenuation and may communicate an output signal to the tuning circuit 103. The tuning circuit 103 may be configured to pass a signal at the frequency of the output signal generated by the PAD 101. The tuning circuit 103 may generate an output signal that may be communicated to the PA 105. The PA 105 may provide gain or attenuation and communicate an output signal to the input of the switch 107. The switch 107 may couple a selected antenna, 109, 111, 113 or 115 to the matching circuit 119. The selected antenna may transmit an output signal at a desired frequency and at a desired power level, −50 to +30 dBm, for example.

In accordance with various embodiments of the invention, a single output stage, such as the tunable output stage 100, may be utilized to transmit RF signals at a variety of selectable frequencies with a tunable bandwidth. Conventional systems may require multiple output stages and antennas to transmit at different frequencies, where each of the multiple stages utilizes one or more PAs and PADs, thus greatly increasing die size and power requirements.

Figure 2:
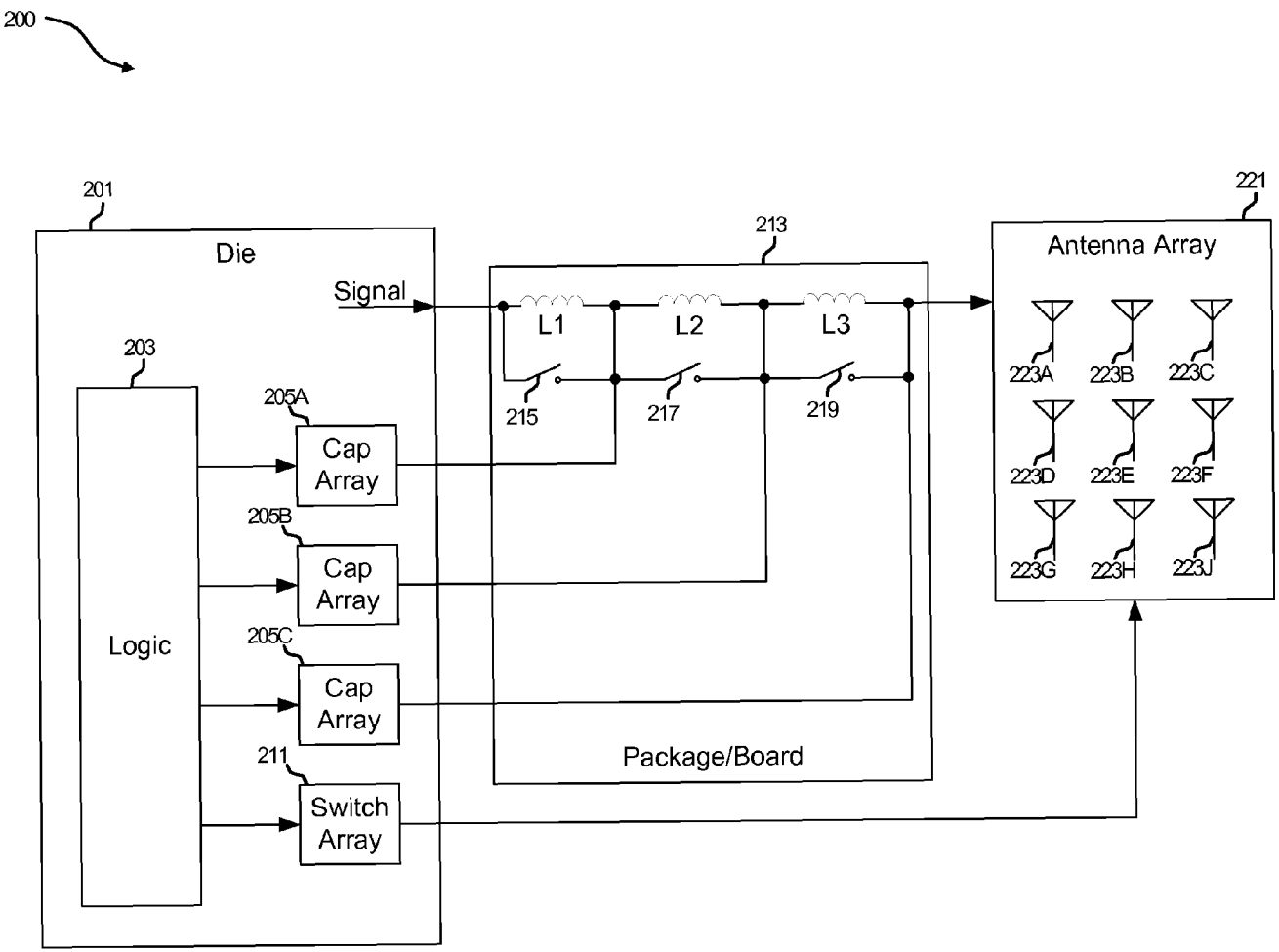
FIG. 2 is a block diagram of an exemplary antenna array and associated circuitry, in accordance with an embodiment of the invention.

FIG. 2 is a block diagram of an exemplary antenna array and associated circuitry, in accordance with an embodiment of the invention. Referring to FIG. 2, there is shown tunable antenna system 200 comprising a die 201, a package/board 213 and an antenna array 221. The die 201 may comprise a logic block 203, capacitor arrays 205A, 205B and 205C, and a switch array 211. The die 201 may also comprise suitable circuitry, logic and/or code for generating an output signal to be communicated to the package/board 213.

The logic block 203 may comprise suitable circuitry, logic and/or code for controlling the capacitor arrays 205A, 205B and 205C and the switch array 211. The capacitor arrays 205A, 205B and 205C may comprise individually addressable arrays of capacitors that may be utilized for impedance matching with the antenna array 221. The capacitor arrays 205A, 205B and 205C may receive as inputs, control signals from the logic block 203.

The switch array 211 may comprise individually addressable switches, an array of transistors, for example, that may be enabled to activate one or more antennas in the antenna array 221. The switch array 211 may receive as inputs, control signals from the logic block 223. Enabling one or more antennas for a particular band may allow smart antenna techniques such as beam forming and multi-antenna diversity to be utilized.

The package/board may comprise inductors L1, L2 and L3, and switches 215, 217 and 219. The switches 215, 217 and 219 may be utilized to bypass the inductors L1, L2 and L3, thus changing the impedances in the LC circuit formed by the inductors L1, L2 and L3, and the capacitor arrays 205A, 205B and 205C. This may be performed to impedance match the selected antenna from the antenna array 221 to a PA, such as the PA 105 described with respect to FIG. 1B. The invention is not limited in the number of inductors illustrated in FIG. 2. The number of inductors may be determined by the impedance matching requirements of the antennas in the antenna array 221.

The antenna array 221 may comprise an array of individually addressable and configurable antennas 223A, 223B, 223C, 223D, 223E, 223F, 223G, 223H and 223J. The invention is not limited in the number of antennas illustrated in FIG. 2, and may be designed to contain any number of antennas dependent on the number of frequency ranges desired. Each antenna may be designed to transmit in a particular frequency range, and may also be tunable within that frequency range, as described further with respect to FIG. 3. In a diversity system, for example, two or more antennas may be configured to transmit and/or receive at a particular frequency. The antenna array 221 may comprise frequency tunable antennas such as pixel-patch, scan-beam spiral, or microstrip antennas, for example.

In operation, an analog input signal may be communicated from the die 201 to the package/board 213 via the inductors L1, L2 and/or L3 and to a selected antenna or antennas of the antenna array 221 for wireless transmission. The required inductance may be determined by the impedance of the selected antenna or antennas, and may be configured by the switches 215, 217 and/or 219. The required capacitance may be determined by the logic 203, which may enable an appropriate capacitor array 205A, 205B, and/or 205C, may also depend on the impedance of the selected antenna or antennas. The antenna or antennas of the antenna array 221 that may be utilized to transmit the analog input signal may be selected utilizing the switch array 211. The selection of the antennas may depend on the frequency of the analog input signal and/or the desired beam shape and/or polarization, for example.

Figure 3:
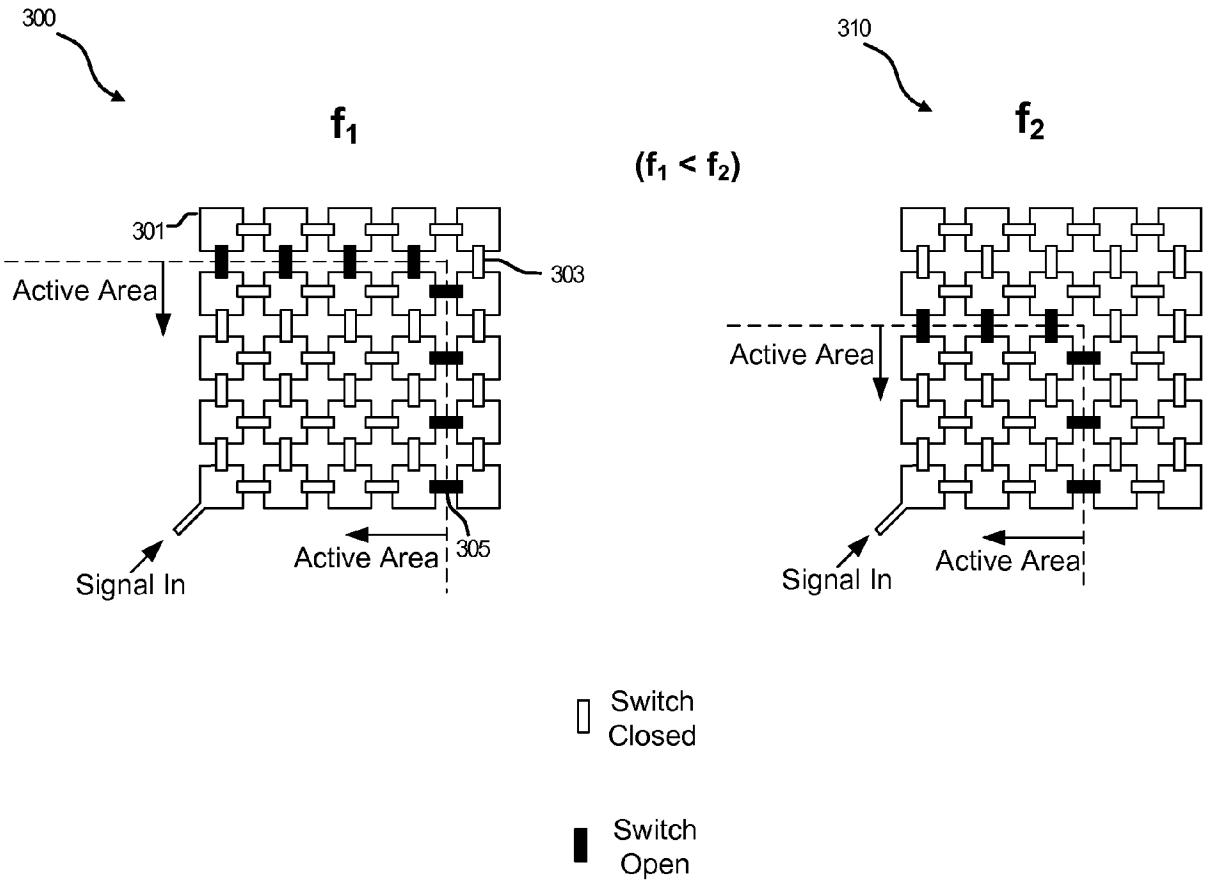
FIG. 3 is a block diagram illustrating an exemplary tunable antenna, in accordance with an embodiment of the invention.

FIG. 3 is a block diagram illustrating exemplary tunable antennas, in accordance with an embodiment of the invention. Referring to FIG. 3, there is shown tunable antennas 300 and 310 each comprising an array of pixel patches, such as the pixel patch 301, and switches, such as the switch 303. The number of pixel patches or switches per antenna is not limited by the number illustrated in FIG. 3. The active area of the tunable antennas 300 and 310 may be adjusted by activating appropriate switches, as indicated by the switches which have been blackened, or open, such as the switch 305, and closed switches which are shown in FIG. 3 as white rectangles, such as the switch 303.

In operation, the frequency range of transmission for the tunable antennas 300 and 310 may be defined by the active area, as indicated in FIG. 3 by the area enclosed by the open switches, such as the switch 305. If the active area is reduced as illustrated in the tunable antenna 310, the frequency of transmission may be greater than for the larger active area tunable antenna 300. In addition, the polarization of the transmitted field and the beam shape may be controlled by activating appropriate switches in the tunable antennas 300 and/or 310.

Figure 4:
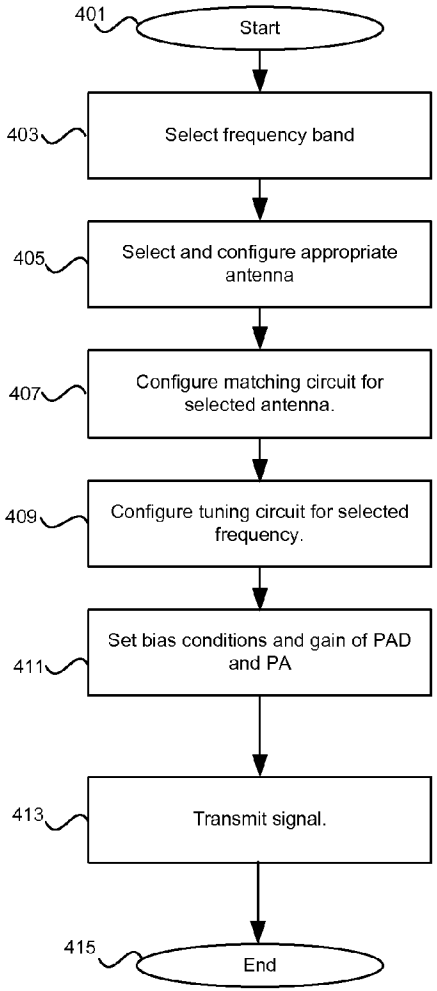
FIG. 4 is a flow diagram illustrating an exemplary process for controlling a software defined antenna, in accordance with an embodiment of the invention.

FIG. 4 is a flow diagram illustrating an exemplary process for controlling a software defined antenna, in accordance with an embodiment of the invention. Referring to FIG. 4, after start step 401, in step 403, the frequency range of operation of the tunable output stage 100 may be selected. In step 405, the antenna 223A, 223B, 223C, 223D, 223E, 223F, 223G, 223H or 223J may be selected and configured for desired characteristics, such as frequency within the selected frequency range, beam shape and/or polarization. In step 407, the matching circuit 119 may be configured to impedance match the selected antenna 223A, 223B, 223C, 223D, 223E, 223F, 223G, 223H or 223J with the PA 105. In step 409, the tuning circuit 103 may be configured to pass a signal generated by the PAD 101 at the selected frequency. In step 411, the gain and bias conditions of the PAD 101 and the PA 105 may be set depending on the power requirements of the application. In step 413, the signal may be transmitted by the selected antenna 223A, 223B, 223C, 223D, 223E, 223F, 223G, 223H or 223J, followed by end step 415.

In an embodiment of the invention, one of a plurality of tunable antennas in an antenna array 221 may be selectively coupled and impedance matched to a single programmable output stage 100 comprising a single power amplifier 105 on a chip in a transmitter. A programmable matching circuit 119 comprising adjustable inductance L1, L2 and L3 and capacitance 205A, 205B and 205C may be used to impedance match the antenna to the output stage 100. The selected tunable antenna may be coupled to the output stage 100 utilizing a programmable switch array, which may comprise at least one integrated transistor, for example. The tunable antennas may be designed to operate in different frequency bands and to be tuned within one or more frequency bands. The programmable matching circuit 119 may be integrated on the chip or external to the chip. The matching circuit capacitance 205A, 205B and 205C may be integrated on-chip, and the inductance L1, L2 and L3 may be located off-chip.

Certain embodiments of the invention may comprise a machine-readable storage having stored thereon, a computer program having at least one code section for communicating information within a network, the at least one code section being executable by a machine for causing the machine to perform one or more of the steps described herein.

Accordingly, aspects of the invention may be realized in hardware, software, firmware or a combination thereof. The invention may be realized in a centralized fashion in at least one computer system or in a distributed fashion where different elements are spread across several interconnected computer systems. Any kind of computer system or other apparatus adapted for carrying out the methods described herein is suited. A typical combination of hardware, software and firmware may be a general-purpose computer system with a computer program that, when being loaded and executed, controls the computer system such that it carries out the methods described herein.

One embodiment of the present invention may be implemented as a board level product, as a single chip, application specific integrated circuit (ASIC), or with varying levels integrated on a single chip with other portions of the system as separate components. The degree of integration of the system will primarily be determined by speed and cost considerations. Because of the sophisticated nature of modern processors, it is possible to utilize a commercially available processor, which may be implemented external to an ASIC implementation of the present system. Alternatively, if the processor is available as an ASIC core or logic block, then the commercially available processor may be implemented as part of an ASIC device with various functions implemented as firmware.

The present invention may also be embedded in a computer program product, which comprises all the features enabling the implementation of the methods described herein, and which when loaded in a computer system is able to carry out these methods. Computer program in the present context may mean, for example, any expression, in any language, code or notation, of a set of instructions intended to cause a system having an information processing capability to perform a particular function either directly or after either or both of the following: a) conversion to another language, code or notation; b) reproduction in a different material form. However, other meanings of computer program within the understanding of those skilled in the art are also contemplated by the present invention.

While the invention has been described with reference to certain embodiments, it will be understood by those skilled in the art that various changes may be made and equivalents may be substituted without departing from the scope of the present invention. In addition, many modifications may be made to adapt a particular situation or material to the teachings of the present invention without departing from its scope. Therefore, it is intended that the present invention not be limited to the particular embodiments disclosed, but that the present invention will include all embodiments falling within the scope of the appended claims.

What is claimed is:

1. A method for controlling signals in a wireless communication system, the method comprising:

selectively coupling a single programmable output stage to one or more antennas of a tunable antenna array;

enabling the selectively coupled one or more antennas of the tunable antenna array utilizing a programmable switch array comprising at least one transistor integrated on the same chip as the single programmable output stage; and impedance matching the selectively coupled one or more antennas of the tunable antenna array to the single programmable output stage using a programmable matching circuit.

2. The method according to claim 1, wherein the impedance matching comprises programmably adjusting at least an inductance and a capacitance in the programmable matching circuit.

3. The method according to claim 1, wherein each of the selectively coupled one or more antennas is configured to operate in a different frequency band.

4. The method according to claim 1, comprising configuring the selectively coupled one or more antennas to operate in a specific frequency band.

5. The method according to claim 1, comprising tuning the selectively coupled one or more antennas to operate within one or more frequency bands.

6. The method according to claim 1, wherein the programmable matching circuit is within an integrated circuit comprising the single programmable output stage.

7. The method according to claim 1, wherein the programmable matching circuit is external to an integrated circuit comprising the single programmable output stage.

8. The method according to claim 1, wherein the single programmable output stage comprises a single power amplifier.

9. The method according to claim 2, wherein the capacitance is within an integrated circuit comprising the single programmable output stage.

10. The method according to claim 2, wherein the inductance is external to an integrated circuit comprising the single programmable output stage.

11. A system for controlling signals in a wireless communication system, the system comprising:

one or more circuits operable to selectively couple a single programmable output stage to one or more antennas of a tunable antenna array; and the one or more circuits comprising a programmable matching circuit that is operable to impedance match the selectively coupled one or more antennas of the tunable antenna array to the single programmable output stage, wherein the programmable matching circuit is within an integrated circuit comprising the single programmable output stage.

12. The system according to claim 11, wherein the one or more circuits are operable to programmably adjust at least an inductance and a capacitance in the programmable matching circuit.

13. The system according to claim 11, wherein the one or more circuits comprises a programmable switch array that is operable to selectively couple one of the one or more antennas of the tunable antenna array utilizing the programmable switch array.

14. The system according to claim 13, wherein the programmable switch array comprises at least one transistor.

15. The system according to claim 11, wherein the one or more circuits are operable to tune the one or more antennas of the tunable antenna array to operate within one or more frequency bands.

16. The system according to claim 11, wherein the single programmable output stage comprises a single power amplifier.

17. A system for controlling signals in a wireless communication system, the system comprising:

one or more circuits operable to selectively couple a single programmable output stage to one or more antennas of a tunable antenna array; and the one or more circuits comprising a programmable matching circuit that is operable to impedance match the selectively coupled one or more antennas of the tunable antenna array to the single programmable output stage, wherein the programmable matching circuit is external to an integrated circuit comprising the single programmable output stage.

18. The system according to claim 17, wherein the one or more circuits are operable to programmably adjust at least an inductance and a capacitance in the programmable matching circuit.

19. The system according to claim 17, wherein the one or more circuits comprises a programmable switch array that is operable to selectively couple one of the one or more antennas of the tunable antenna array utilizing the programmable switch array.

20. The system according to claim 17, wherein the one or more circuits are operable to tune one or more of the plurality of tunable antennas to operate within one or more frequency bands.

* * * * *